US006071154A

United States Patent [19]

Dung

[11] Patent Number: 6,071,154

[45] Date of Patent: Jun. 6, 2000

[54] REMOVEABLE CONNECTION OF A HIGH-VOLTAGE CABLE WITH A COLLECTOR RAIL-TYPE CONNECTOR

[75] Inventor: Herbert Dung, Dortmund, Germany

[73] Assignee: Flohe GmbH & Co., Castrop-Rauxel, Germany

[21] Appl. No.: 09/135,626

[22] Filed: Aug. 18, 1998

[30] Foreign Application Priority Data

Oct. 4, 1997 [DE] Germany ..... 197 43 867

[51] Int. Cl.[7] ..... H01R 4/30

[52] U.S. Cl. ..... 439/801; 439/804

[58] Field of Search ..... 439/801, 409, 439/410, 411, 421, 422, 435, 496, 13, 14, 725, 726, 804, 807, 785, 6, 492, 495

[56] References Cited

U.S. PATENT DOCUMENTS

| | | | |
|---|---|---|---|
| 881,520 | 3/1908 | Wilson | 439/801 |
| 2,551,636 | 5/1951 | Ratigan | 439/801 |
| 2,687,517 | 8/1954 | Despard | 439/801 |
| 2,849,777 | 9/1958 | Ridgers et al. | 439/801 |
| 3,380,014 | 4/1968 | Schenker et al. | 439/801 |
| 5,160,285 | 11/1992 | Murray | 439/801 |

*Primary Examiner*—Paula Bradley
*Assistant Examiner*—Alexander Gilman
*Attorney, Agent, or Firm*—Max Fogiel

[57] ABSTRACT

A disconnectable power-cable connector with a bus-shaped connection blade, in which a solid connecting member is wider at one end, and a matching wedge-shaped contact housing is open along one side. The connection member is fastened to the wedge-shaped contact housing in vicinity of the blade. A cable has an end that extends into the connecting member which is insertable into the contact housing perpendicularly to the longitudinal axis of the contact housing. A bar extends across the top surface of a receptacle for the connecting member, and rests on top of the connecting member after having been into the contact housing.

8 Claims, 2 Drawing Sheets

REMOVEABLE CONNECTION OF A HIGH-VOLTAGE CABLE WITH A COLLECTOR RAIL-TYPE CONNECTOR

BACKGROUND OF THE INVENTION

The present invention concerns a disconnectible power-cable connector with a bus-like connection blade. The end of the cable extends into a solid connecting piece that is wider at one end and is fastened in the vicinity of the blade to a matching wedge-shaped contact housing. The contact housing is open along one side, and the connecting piece can be inserted into it perpendicularly to its longitudinal axis, whereupon the open side of the housing can be screwed shut.

A disconnectible power-cable connector with a bus-like connection blade of the aforesaid genus is disclosed in German D 3 423 175. Such connectors have long proven useful for multiple-output cables, especially for electrical-arc furnaces, which need to have their supply lines constantly interchanged. The connectors facilitate attaching and detaching the cables. Another advantage of such connectors is the reliable continuity of current from the connecting piece to its housing. Still, the frequent motion the cables are subjected to when employed with electric-arc furnaces tend to loosen the attachment between the connecting piece and the its housing to the detriment of current continuity etc.

SUMMARY OF THE INVENTION

With the aforesaid state of the art as a point of departure, the object of the present invention is to ensure reliable attachment between the connecting piece and the contact housing.

This object is attained in a disconnectible power-cable connector with a bus-like contact of the aforesaid genus in that the contacting piece can be inserted into the contact housing without extending beyond its top and by a bar that extends across the top of the accommodation or receptacle provided in the contact housing for the connecting piece, that rests directly or indirectly on top of the connecting piece once the piece has been inserted into the contact housing, and that can be attached to and detached from the contact housing. Once it has been inserted into the housing, the top of the connecting piece can be on the same level as the top of the housing with the bar resting directly against the connecting piece. Alternatively, the top of the connecting piece can rest against the top of the contact piece by way of either a spacer or an elevation on the bottom of the bar. The advantage of the elevation is that it will allow the bar to exert force on the connecting piece to improve the surface-to-surface contact between the connecting piece and the contact housing. Manufacturing tolerances can also be dealt with more effectively.

BRIEF DESCRIPTION OF THE DRAWINGS

The present invention will now be specified with reference to the accompanying drawing, wherein.

DESCRIPTION OF THE PREFERRED EMBODIMENTS

Figure 2:
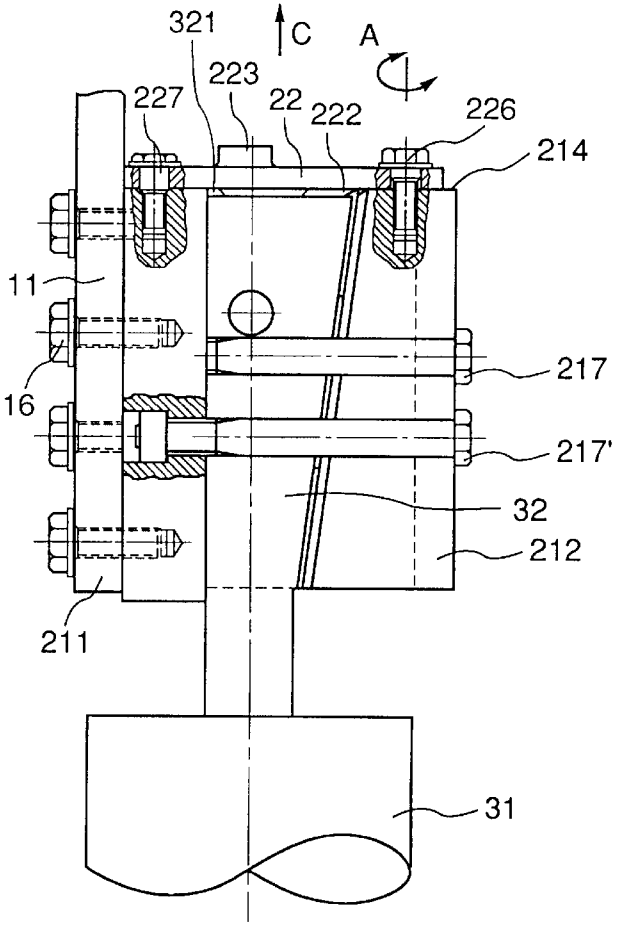
FIG. 2 is a partly broken side view of the connector, and FIG. 3 a partly broken top view of the connector.
Figure 1:
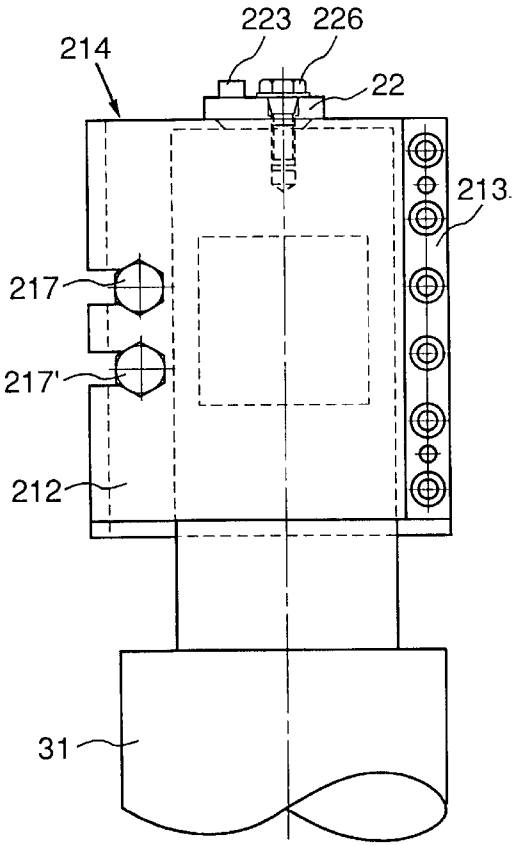
FIG. 1 is a front view of the connector in accordance with the present invention.
Figure 3:
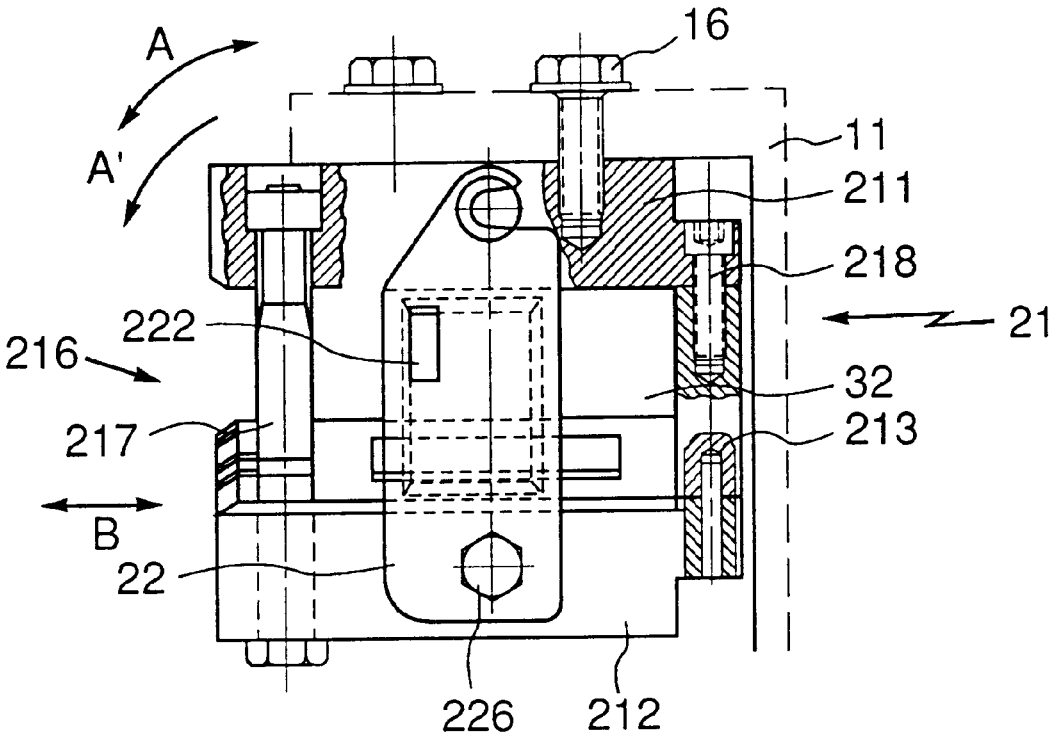

A contact housing 21 comprises a rear wall 211 and a front wall 212 connected by a side wall 213. Housing 21 is secured to what is called a connection blade 11 by screws 16 that extend through the blade and screw into rear wall 211. Contact housing 21 is conventionally designed to accommodate a wedge-shaped connecting piece 32 secured to the end of a power cable 31. In this particular embodiment. the top 321 of connecting piece 32 does not, as will be especially evident from FIG. 2, rest against the top 214 of contact housing 21 once the connecting piece has been inserted into housing 21. A bar 22 pivots against the top 214 of contact housing 21 in the senses indicated by the double-headed arrows A in FIGS. 2 and 3 on a screw 226 that extends through the bar and is screwed into the front wall 212 of contact housing 21. With bar 22 extending across the accommodation for connecting piece 32 in contact housing 21 as illustrated in FIGS. 1 through 3, the bar's claw-like end 221 engages the shaft of a screw 227 screwed into the rear wall 211 of contact housing 21. Once screws 226 and 227 have been tightened, bar 22 will exert force by way of an elevation 222 on its lower surface on the connecting piece 32 at the end of cable 31 where the piece hooks into contact housing 21. This force will ensure total surface-to-surface contact between connecting piece 32 and contact housing 21. Bar 22 will also help to keep the components in place during long-term operation. Two screws 217 and 217' conventionally extend across the open side 216 of contact housing 21 as viewed along the direction of insertion indicated by double-headed arrow B in FIG. 3.

How cable 31 is replaced will now be specified. The screws 217 and 217' that extend across the open side 216 of contact housing 21 from rear wall 211 to front wall 212 are extracted. The screws 226 and 227 that force bar 22 against the top 214 of contact housing 21 are loosened. The bar is pivoted approximately 90° in the direction indicated by arrow A', out of the position wherein it extends across the accommodation for connecting piece 32 in contact housing 21 and secures the installed connecting piece 32. Connecting piece 32 can now be lifted to a certain extent in the direction indicated by arrow C in FIG. 2 and with cable 31 extending out of contact housing 21 through open side 216. A fresh cable 31 can now be inserted with its connecting piece 32 into contact housing 21 in the opposite direction indicated by arrow B in FIG. 3.

Bar 22 is provided with a grip 223. For manufacturing economy, contact housing 21 is composed of several parts—rear wall 211, front wall 212, and side wall 213—secured together by screws 218 etc. for example.

The bar 22 that extends across the accommodation for connecting piece 32 in contact housing 21 and rests against the connecting piece 32 inserted in the housing ensures that the satisfactory electrical contact between the housing and the connecting piece will be maintained even during long-term operation.

I claim:

1. A disconnectable power-cable connector with a bus-shaped connection blade, comprising: a solid connecting member wider at one end; a matching wedge-shaped contact housing open along one side and having a longitudinal axis; said solid connecting member being fastened to said wedge-shaped contact housing in vicinity of said blade; a cable having an end extending into said solid connecting member; said connecting member being insertable into said contact housing perpendicularly said longitudinal axis; means for screwing shut said open side of said contact housing; said contact housing having receiving means for said connecting member; a bar extending across a top surface of said receiving means, said connecting member being insertable into said contact housing without extending beyond a top surface of said contact housing; said bar resting on top of said connecting member after said connecting member has been inserted into said contact housing, said bar being removably attachable to said contact housing.

2. A connector as defined in claim 1, wherein said top of said connecting member is on the same level as said top of said contact housing when said connecting member is inserted into said contact housing.

3. A connector as defined in claim 1, including a spacer, said top of said connecting member resting against said top of said contact housing through said spacer when said connecting member is inserted into said contact housing.

4. A connector as defined in claim 1, including a projection on a bottom of said bar, said top of said connecting member resting against said top of said contact housing through said projection when said connecting member is inserted into said contact housing.

5. A connector as defined in claim 1, including a grip on top of said bar.

6. A connector as defined in claim 1, including screw means having a head resting against said bar and being threaded into said contact housing, said bar having one end pivoting on said contact housing and having another end secured to said contact housing by said screw means.

7. A connector as defined in claim 4, including a first screw with a head resting against said bar and being threaded into said contact housing; pivot means in form of a second loosenable screw for pivoting one end of said bar to one side on said contact housing; said bar having another end secured to said contact housing by said first screw.

8. A connector as defined in claim 6, wherein said screw extends through a passage in form of a claw at said one end of said bar for securing said bar to said contact housing, said screw having a shaft received by said claw when said bar is pivoted into an engaged position.

* * * * *